US008610658B2

(12) United States Patent
Haupt et al.

(10) Patent No.: US 8,610,658 B2
(45) Date of Patent: Dec. 17, 2013

(54) CIRCUITRY AND METHOD FOR REDUCING POWER CONSUMPTION IN GAMMA CORRECTION CIRCUITRY

(75) Inventors: Frank Haupt, Nuertingen (DE); David R. Baum, Tucson, AZ (US)

(73) Assignees: Texas Instruments Deutschland GmbH, Freising (DE); Texas Instruments Incorporated, Dallas, TX (US)

( * ) Notice: Subject to any disclaimer, the term of this patent is extended or adjusted under 35 U.S.C. 154(b) by 998 days.

(21) Appl. No.: 12/317,119

(22) Filed: Dec. 19, 2008

(65) Prior Publication Data

US 2010/0156944 A1 Jun. 24, 2010

(51) Int. Cl.
*G09G 3/36* (2006.01)

(52) U.S. Cl.
USPC ..... 345/100; 341/144

(58) Field of Classification Search
USPC ..... 345/89, 98–100, 204, 690, 211–213; 341/126–172
See application file for complete search history.

(56) References Cited

U.S. PATENT DOCUMENTS

2006/0202929 A1 9/2006 Baum et al. ..... 345/89

FOREIGN PATENT DOCUMENTS

WO WO 2007057801 A1 * 5/2007

* cited by examiner

*Primary Examiner* — Liliana Cerullo
(74) *Attorney, Agent, or Firm* — Alan A. R. Cooper; W. James Brady, III; Frederick J. Telecky, Jr.

(57) ABSTRACT

Gamma curve correction circuitry includes first (24-1,2 . . . 11) and second (24-12,13 . . . 22) groups of gamma correction buffers and corresponding DACs (28-1,2 . . . 22). Each buffer has an input coupled to an output of a corresponding DAC, respectively, and an output coupled by a corresponding output conductor, respectively, to a corresponding resistor string tap point. A midrange voltage ($V_{30}$) is produced with a value approximately midway between a first voltage ($V_{DD}$) and a second voltage (GND) and is coupled to provide power to the first and second groups of buffers. The first voltage is coupled to a first voltage terminal of a first buffer (24-11) of the first group. A second voltage terminal of the first buffer is coupled to the midrange voltage. The midrange voltage is coupled to a first voltage terminal of a first buffer (24-12) of the second group. A second voltage terminal of the first buffer of the second group is coupled to the second voltage.

18 Claims, 9 Drawing Sheets

CIRCUITRY AND METHOD FOR REDUCING POWER CONSUMPTION IN GAMMA CORRECTION CIRCUITRY

BACKGROUND OF THE INVENTION

The present invention relates generally to improved circuits and methods for generating the gamma correction voltages required for achieving satisfactory performance in driving LCD displays (liquid crystal displays), and more particularly to circuits and methods which allow reduced size and power consumption of gamma correction buffers in gamma generator systems that are used in conjunction with column drivers of LCD display systems.

The closest prior art is believed to include the assignee's pending patent application entitled "METHOD AND APPARATUS FOR SETTING GAMMA CORRECTION VOLTAGES FOR LCD SOURCE DRIVERS", Publication No. 20060202929, Ser. No. 11/079,357 filed Mar. 14, 2005 by Baum et al. and incorporated herein by reference.

Color LCD displays are widely used for desktop computers, laptop computers, and TVs, and consist of LCD pixel elements that typically are controlled by a matrix of intersecting gate drivers (also known as row drivers) and source drivers (also known as column drivers). In "Prior Art" FIG. 1 (which is the same as FIG. 4 in the above referenced Baum et al. application), LCD display system 10 includes a LCD display panel 11 having many rows (depending on the height of LCD display panel 11) of LCD pixels selectable by lines 14 that are driven by gate driver circuitry 12 in response to signals sent by controller circuitry 32 via conductor or bus 38. LCD display panel 11 includes many columns (e.g., as many as 4096 columns are more depending on the width of the LCD display panel 11) of LCD pixels coupled, respectively, to gamma reference voltage signals produced on conductors 20-1,2 . . . *q* by a resistor-string DAC 16, where q is the number of columns of pixels.

The switches in source switch driver circuitry 18 are used to tap off the various voltages of R-DAC 23. The corrected gamma curve is established by programming the desired voltages along the various tap points of R-DAC 23. Then the source driver switch circuitry 18 can connect the appropriate voltages to the R-DAC outputs 20-1,2 . . . , and hence to the appropriate control terminals of the LCD display, at the appropriate times. Source driver switch circuitry 18 in resistor-string DAC 16 produces intensity or brightness control signals on conductors 20-1,2 . . . *q* for controlling the gray scale (i.e., the brightness or intensity of the LCD pixels in each column at its intersections with the selected rows).

The source drivers in source driver switch circuitry 18 are used to control the gray scale of each pixel by converting the digital image data 36 into corresponding voltages produced by means of resistor-string DAC 22 and multiplexing the appropriate voltages by means of the source driver switch circuitry 18 to the appropriate LCD brightness control outputs 20-1,2 . . . *q* to corresponding columns of pixel elements.

The gray scale transmission characteristic of resistor-string DAC 22 is typically "nonlinear" to compensate for the nonlinear transmission characteristic of the LCD display 11. The nonlinear behavior of the resistor-string DAC 22 can be thought of as being represented by an "intrinsic" gamma correction curve (sometimes also referred to as a "color curve"). The nonlinear transfer function of each LCD display 11 is unique, and therefore the intrinsic gamma curve built into the source driver circuitry 16 by resistor-string DAC 22 ordinarily must be modified to achieve optimum display performance of a particular LCD display screen. The "gamma voltage correction" involves correcting the above-mentioned intrinsic gamma curve so as to make the "gray scale" of displayed LCD screen images appear more satisfactory in the eyes of a trained expert.

The string DAC resistors 23 are connected in series between a high reference voltage VH and a low reference voltage VL, and the voltages on conductors 19-1,2 . . . *m* generally define a corrected gamma curve. (As an example, the number of resistors is m=256 for an 8-bit source driver.)

Gamma reference voltage generator circuit 35 includes logic circuitry 30, DACs 28-1,2 . . . *m* and buffers 24-1,2 . . . *m*. (Buffers 24-1,2 . . . *m* also are referred to herein as "buffer amplifiers" and as "gamma correction buffers".) Buffers 24-1,2 . . . *m* could be included within DACs 28-1,2 . . . *m*. Gamma reference voltage generator 35 is coupled by a conventional $I^2C$ bus 34 including a SDA conductor and a SCL conductor to controller 32. Outputs of logic circuit 30 are connected to the inputs of DACs 28-1,2 . . . *m*, the outputs of which are connected to inputs of corresponding buffers 24-1,2 . . . *m*, respectively. The outputs of buffers 24-1,2 . . . *m* are connected to conductors 19-1,2 . . . *m*, respectively, which may be but are not necessarily directly connected to the q inputs of source driver switch circuitry 18. The output voltage values of buffers 24-1,2 . . . *m* are determined by the reference voltages VH and VL and by the value of the binary input code (not shown) used to "program" that buffer.

Logic circuit 30 operates in response to data and clock signals received on $I^2C$ bus 34 from controller 32 and performs the function of assembling the digital inputs for DACs 28-1, 2 . . . *m* so as to produce desired gray scale or intensity of pixels in the row currently selected by gate drive circuitry 12 in response to digital gray scale codes received from either an internal non-volatile memory of the controller 32 or from an external EEPROM and converted to the digital signals that are applied to the inputs of the various DACs.

Gamma correction buffers 24-1,2 . . . *m* must supply most of the correction currents from buffers that are almost midway between the power supplies $V_H$ and $V_L$. This is the worst case for power consumption in the gamma correction buffers. LCD manufacturers have been concerned about this problem for some time and desire a solution that will reduce the power and the size of gamma correction circuitry for state-of-the-art LCD display systems. The various competitors in the field are believed to be working on various ways of reducing the above mentioned power dissipation.

Perhaps this can be understood by referring to "Prior Art" FIG. 2, wherein the DAC/buffers 35-1 each have an output coupled to a corresponding voltage tap point of a resistor string 23-1. The resistor string can be part of a single R-DAC 23 as shown in FIG. 1. More typically in state-of-the-art LCD display systems, the resistor string can be divided into multiple resistor strings which are included in R-DACs (resistor DACs), respectively, such as "upper R-DAC" 23-1 and "lower R-DAC 23-2", as also shown in subsequently described FIG. 3A. (Whether the resistor string is divided into multiple resistor strings which are included in multiple R-DACs, respectively, depends on the LCD panel that is to be driven by the gamma curve circuitry.)

In FIG. 2, the various illustrated sinking currents and sourcing currents, i.e., the gamma correction currents, flowing into and out of the output terminals of the various gamma correction buffers 24-1,2 . . . 22 all are determined by the values of digital input signals (not shown) which are programmed into the corresponding DACs 28-1,2 . . . 22, depending on the particular LCD panel to which the gamma correction buffers are connected in order to correct the intrinsic gamma curve of that LCD panel. Note that the values of resistors R1,2 . . . 20 are shown in FIG. 2. The gamma correction currents flowing in the gamma correction buffer output conductors 40-1,2 . . . 22 also are shown in FIG. 2. The tap voltages V0,1,2 . . . 21 have been digitally programmed into the corresponding DACs 28-1,2 . . . 22 and produced in analog form by the corresponding gamma correction buffers 24-1,2 . . . 22. The tap voltages V0,1 . . . 20 represent the corrected gamma curve of LCD display panel 11, and are illustrated along the right sides of resistor strings 23-1 and 23-2 in FIG. 2.

In the example of FIG. 2, all of the gamma correction buffers 24-1,2 . . . 22 are powered by $V_{DD}$ and ground, where $V_{DD}$ is 18 V. Whether a particular one of gamma correction buffers 24-1,2 . . . 10 and gamma correction buffers 24-13 . . . 22 operates to source a gamma correction current or to sink a gamma correction current depends on the corresponding digital input gamma correction current value which has been programmed into its corresponding DAC. In this example, the top terminal voltage V0 of upper resistor string 23-1 is a 16.4 volt output of buffer 24-1 and has been programmed by a digital input 26 (FIG. 3B) to DAC 28-1. V0 is 1.6 volts below $V_{DD}$, which is 18 volts. In this example, a 2.408 milliampere current flows into the output terminal of buffer 24-11, which is the bottom buffer in upper R-DAC 23-1.

In a typical LCD display system, a corresponding gamma correction buffer typically would be included for each of 10 or more R-DACs. If the LCD display system having the intrinsic gamma curve represented by the values of resistors R1,2 . . . 20 indicated in FIG. 2 has 10 upper and lower R-DACs, the total gamma correction current into the outputs of the 10 upper R-DAC buffers 24-11 would be 24.08 mA. This current would flow through a voltage drop of V10=8.613 volts in the buffer output transistors absorbing that current, resulting in a undesirably large amount of power dissipation of 207.4 milliwatts. Also, a current of 2.562 mA would flow out of the buffer output terminals of each of the 10 lower R-DAC buffers 24-12. This total current of 25.62 mA would flow through a voltage drop of $V_{DD}$ minus V11, i.e., 18-8.41=9.59 volts, and in the buffer output transistors delivering that total current, resulting in another undesirably large amount of power dissipation of 245.7 mW.

Note that power dissipation in the other buffers 24-1,2 . . . 10 and buffers 24-13 . . . 22 is much lower than in the two "middle" buffers 24-11 and 24-12 because the two "midrange" gamma correction buffers 24-11 and 24-12 sink and source, respectively, the total current through the upper resistor string 23-1 and the lower resistor string 23-2, respectively. However, the other gamma correction buffers sink or source gamma correction currents which are much smaller.

Thus, there is an unmet need for a gamma correction current circuit and method which substantially reduce the amount of power dissipated in an LCD display system.

There also is an unmet need for a gamma correction current circuit and method which substantially reduce the physical size of output transistors in the buffers thereof.

SUMMARY OF THE INVENTION

It is an object of the invention to provide a gamma correction current circuit and method which substantially reduces the amount of power dissipated in an LCD display system, particularly in the gamma correction buffer.

It is another object of the invention to provide a gamma correction current circuit and method which substantially reduces the physical size of output transistors in the buffers thereof.

It is another object of the invention to provide a gamma correction current circuit and method which substantially reduce the amount of power dissipated in an LCD display system and which provide the capability of automatically setting a middle supply voltage level.

It is another object of the invention to provide a gamma correction current circuit and method which substantially reduce the amount of power dissipated in an LCD display system and which provide the capability of programming a middle supply voltage level.

Briefly described, and in accordance with one embodiment, the present invention provides gamma curve correction circuitry which includes first (24-1,2 . . . 11) and second (24-12,13 . . . 22) groups of gamma correction buffers and corresponding DACs (28-1,2 . . . 22). Each buffer has an input coupled to an output of a corresponding DAC, respectively, and an output coupled by a corresponding output conductor, respectively, to a corresponding resistor string tap point. A midrange voltage ($V_{30}$) is produced with a value approximately midway between a first voltage ($V_{DD}$) and a second voltage (GND) and is coupled to provide power to the first and second groups of buffers. The first voltage is coupled to a first voltage terminal of a first buffer (24-11) of the first group. A second voltage terminal of the first buffer is coupled to the midrange voltage. The midrange voltage is coupled to a first voltage terminal of a first buffer (24-12) of the second group. A second voltage terminal of the first buffer of the second group is coupled to the second voltage.

In one embodiment, the invention provides gamma curve correction circuitry (100-1) including a first group (35-1) of gamma correction buffer circuits (24-1,2 . . . 11) and DACs (digital to analog converters) (28-1,2 . . . 11). Each gamma correction buffer circuit (24-1,2 . . . 11) of the first group (35-1) has an input coupled to an output of a corresponding DAC (28-1,2 . . . 11) of the first group (35-1), respectively, and an output coupled by a corresponding output conductor (42-1,2 . . . 11), respectively, to a corresponding tap point of a first resistor string (23-1). In a second group (35-2) of gamma correction buffer circuits (24-12,13 . . . 22) and DACs (28-12,13 . . . 22), each gamma correction buffer circuit (24-12, 13 . . . 22) of the second group (35-2) has an input coupled to an output of a corresponding DAC (28-12,13 . . . 22) of the second group (35-2), respectively, and an output coupled by a corresponding output conductor (42-12,13 . . . 22), respectively, to a corresponding tap point of a second resistor string (23-2). The gamma curve correction circuitry (100-1) is coupled to receive a first supply voltage ($V_{DD}$) and a second supply voltage (GND). A first midrange supply voltage circuit (47,48) produces a first midrange supply voltage ($V_{30}$/$V_{54}$) having a value approximately midway between the first supply voltage ($V_{DD}$) and the second supply voltage (GND). A first gamma correction buffer (24-11) of the first group (35-1) has a high-side supply voltage terminal coupled to receive the first supply voltage ($V_{DD}$) and a low-side supply voltage terminal coupled to receive the first midrange supply voltage ($V_{30}$/$V_{54}$). A first gamma correction buffer (24-12) of the second group (35-2) has a low-side supply voltage terminal coupled to receive the second supply voltage (GND) and a high-side supply voltage terminal coupled to receive the first midrange supply voltage ($V_{30}$/$V_{54}$) to reduce power consumption of the first gamma correction buffer (24-11) of the first group (35-1) and the first gamma correction buffer (24-12) of the second group (35-2).

In the described embodiments, the DACs of the first and second groups are programmable via a digital bus 26 to cause corresponding gamma correction buffers of the first and second groups to generate predetermined gamma curve correction currents in the corresponding output conductors (40-1, 2 . . . 22) of the first and second groups. The predetermined gamma curve correction currents in the corresponding output conductors (40-1,2 . . . 22) of the first and second groups cause corresponding programmed voltages (V0,1,2 . . . 21) representative of a corrected gamma curve of an image display device (11) to be produced on the corresponding output conductors (40-1,2 . . . 22) of the first and second groups, respectively.

In a described embodiment, the first midrange supply voltage circuit (47,48) is programmable to generate the first midrange supply voltage ($V_{30}/V_{54}$) approximately midway between the first supply voltage ($V_{DD}$) and the second supply voltage (GND). The first midrange supply voltage circuit (47,48) includes a first DAC (47) having an output coupled to an input of a first buffer (48), the first buffer (48) having an output coupled to conduct the first midrange supply voltage ($V_{30}/V_{54}$).

In a described embodiment, a non-inverting input of each gamma correction buffer circuit (24-1,2 . . . 22) is coupled to the output of the corresponding DAC (28-1,2 . . . 22), respectively, and the output of each gamma correction buffer circuit (24-1,2 . . . 22) is coupled to an inverting input of that gamma correction buffer circuit (24-1,2 . . . 22). In a described embodiment, most of the gamma correction buffer circuits of the first group (35-1) and most of the gamma correction circuits of the second group (35-2) have high-side supply voltage terminals coupled to the first supply voltage ($V_{DD}$) and low-side supply voltage terminals coupled to the second supply voltage (GND). The first midrange supply voltage ($V_{54}$) is approximately midway between a first midrange programmed voltage (V8) produced by a first midrange one (24-9) of the gamma correction buffer circuits and a second midrange programmed voltage (V11) produced by a second midrange one (24-12) of the gamma correction buffer circuits. The second midrange supply voltage is ($V_{55}$) is approximately midway between a third midrange programmed voltage (V10) produced by a third midrange one (24-11) of the gamma correction buffer circuits and a fourth midrange programmed voltage (V13) produced by a fourth midrange one (24-14) of the gamma correction buffer circuits.

In one embodiment, a second midrange supply voltage circuit (53/57) produces a second midrange supply voltage ($V_{55}$) having a value that is different than the first midrange supply voltage ($V_{30}/V_{54}$) but also is approximately midway between the first supply voltage ($V_{DD}$) and the second supply voltage (GND). In one embodiment, the first midrange supply voltage ($V_{30}/V_{54}$) is approximately midway between a first midrange programmed voltage (V10) produced by a first midrange one (24-11) of the gamma correction buffer circuits and a second midrange programmed voltage (V11) produced by a second midrange one (24-12) of the gamma correction buffer circuits.

In one embodiment, an input of the first DAC (47) is coupled to the digital bus (26) by means of a math function circuit (60) which computes a digital value of value of the first midrange supply voltage ($V_{30}$) between a first midrange programmed voltage (V10) produced by a first midrange one (24-11) of the gamma correction buffer circuits and a second midrange programmed voltage (V11) produced by a second midrange one (24-12) of the gamma correction buffer circuits.

In one embodiment, the first midrange supply voltage circuit includes a first buffer (48) having an output coupled to conduct the first midrange supply voltage ($V_{30}$) and an analog circuit (R101,R102) coupled between a first midrange programmed voltage (V10) produced by a first midrange one (24-11) of the gamma correction buffer circuits and a second midrange programmed voltage (V11) produced by a second midrange one (24-12) of the gamma correction buffer circuits. The analog circuit produces an output voltage on an input of the first buffer (48).

In one embodiment, the invention provides a method for correcting an intrinsic gamma curve of an LCD display (11), including providing first (24-1,2 . . . 11) and second (24-12, 13 . . . 22) groups of gamma correction buffer circuits and corresponding DACs (digital to analog converters) (28-1, 2 . . . 22), each gamma correction buffer circuit (24-1,2 . . . 22) having an input coupled to an output of a corresponding DAC (28-1,2 . . . 22), respectively, and an output coupled by a corresponding output conductor (42-1,2 . . . 22), respectively, to a corresponding resistor string tap point, producing a midrange supply voltage ($V_{30}$) having a value approximately midway between a first supply voltage ($V_{DD}$) and a second supply voltage (GND) coupled to provide power to the first (24-1,2 . . . 11) and second (24-12,13 . . . 22) groups of gamma correction buffer circuits, and coupling the first supply voltage ($V_{DD}$) to a high-side supply voltage terminal of a first gamma correction buffer (24-11) of the first group (24-1, 2 . . . 11), coupling a low-side supply voltage terminal of the first gamma correction buffer (24-11) to the midrange supply voltage ($V_{30}$), coupling the midrange supply voltage ($V_{30}$) to a high-side supply voltage terminal of a first gamma correction buffer (24-12) of the second group (24-12,13 . . . 22), and coupling a low-side supply voltage terminal of the first gamma correction buffer (24-12) of the second group (24-12, 13 . . . 22) to the second supply voltage (GND).

In one embodiment, the method includes programming the DACs of the first and second groups via a digital bus 26 to cause corresponding gamma correction buffers of the first and second groups to generate predetermined gamma curve correction currents in the corresponding output conductors (40-1,2 . . . 22). In one embodiment, the method includes programming a midrange supply voltage circuit (47,48) to generate the midrange supply voltage ($V_{30}$) approximately midway between the first supply voltage ($V_{DD}$) and the second supply voltage (GND).

In one embodiment, the method includes operating a math function circuit (60) to compute a digital value of value of the first midrange supply voltage ($V_{30}$) between a first midrange programmed voltage (V10) produced by a first midrange one (24-11) of the gamma correction buffer circuits and a second midrange programmed voltage (V11) produced by a second midrange one (24-12) of the gamma correction buffer circuits.

In one embodiment, the method includes operating an analog circuit (R101,R102) coupled between a first midrange programmed voltage (V10) produced by a first midrange one (24-11) of the gamma correction buffer circuits and a second midrange programmed voltage (V11) produced by a second midrange one (24-12) of the gamma correction buffer circuits to produce an output voltage on an input of a buffer (48) an output of which produces the midrange supply voltage ($V_{30}$).

In one embodiment, the invention includes circuitry (100-1) for correcting an intrinsic gamma curve of an LCD display (11), including first (24-l,2 . . . 11) and second (24-12,13 . . . 22) groups of gamma correction buffer circuits and corresponding DACs (digital to analog converters) (28-1,2 . . . 22), each gamma correction buffer circuit (24-1,2 . . . 22) having an input coupled to an output of a corresponding DAC (28-1, 2 . . . 22), respectively, and an output coupled by a corresponding output conductor (42-1,2 . . . 22), respectively, to a corresponding resistor string tap point, means (47,48) for producing a midrange supply voltage ($V_{30}$) having a value approximately midway between a first supply voltage ($V_{DD}$) and a second supply voltage (GND) coupled to provide power to the first (24-1,2 . . . 11) and second (24-12,13 . . . 22) groups of gamma correction buffer circuits, and means for coupling the first supply voltage ($V_{DD}$) to a high-side supply voltage terminal of a first gamma correction buffer (24-11) of the first group (24-1,2 . . . 11), means (30) for coupling a low-side supply voltage terminal of the first gamma correction buffer (24-11) to the midrange supply voltage ($V_{30}$), means (30) for coupling the midrange supply voltage ($V_{30}$) to a high-side supply voltage terminal a first gamma correction buffer (24-12) of the second group (24-12,13 . . . 22), and means for coupling a low-side supply voltage terminal of the first gamma correction buffer (24-12) of the second group (24-12, 13 . . . 22) to the second supply voltage (GND).

BRIEF DESCRIPTION OF THE DRAWINGS

FIGS. 2, 2-1, and 2-2 are schematic diagrams of prior art gamma correction buffers for explaining shortcomings thereof.

FIG. 3A, 3A-1, and 3A-2 are schematic diagrams of one embodiment of gamma correction circuitry of the present invention.

DETAILED DESCRIPTION OF THE PREFERRED EMBODIMENTS

Figure 1:
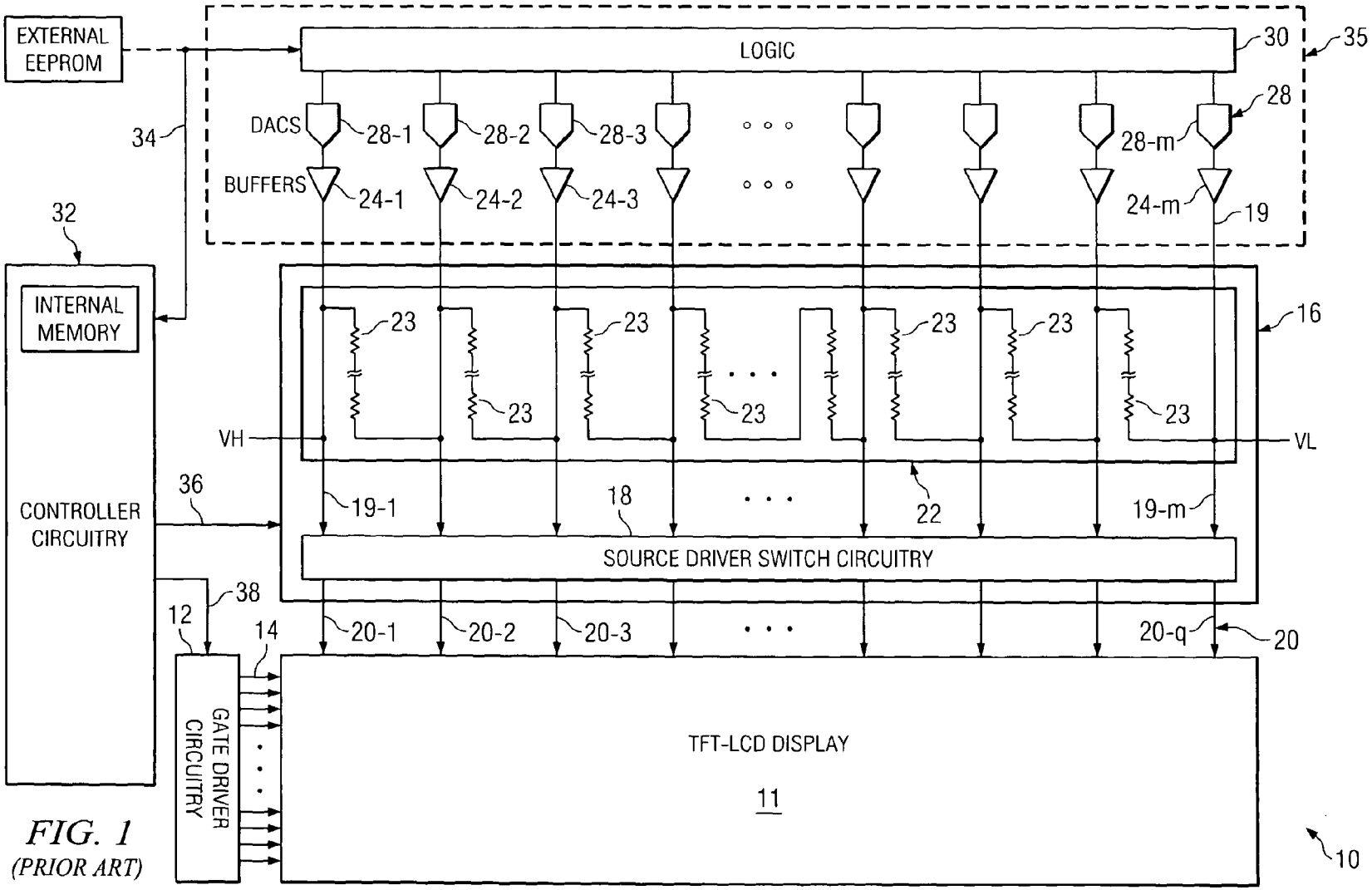
FIG. 1 (PRIOR ART)
FIG. 1 is a schematic diagram showing prior art gamma correction buffers in a prior art LCD display system.
Figure 3A:
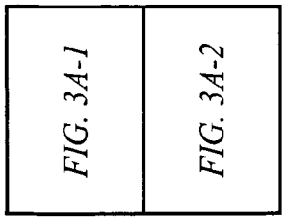
Figures 1, 3A:
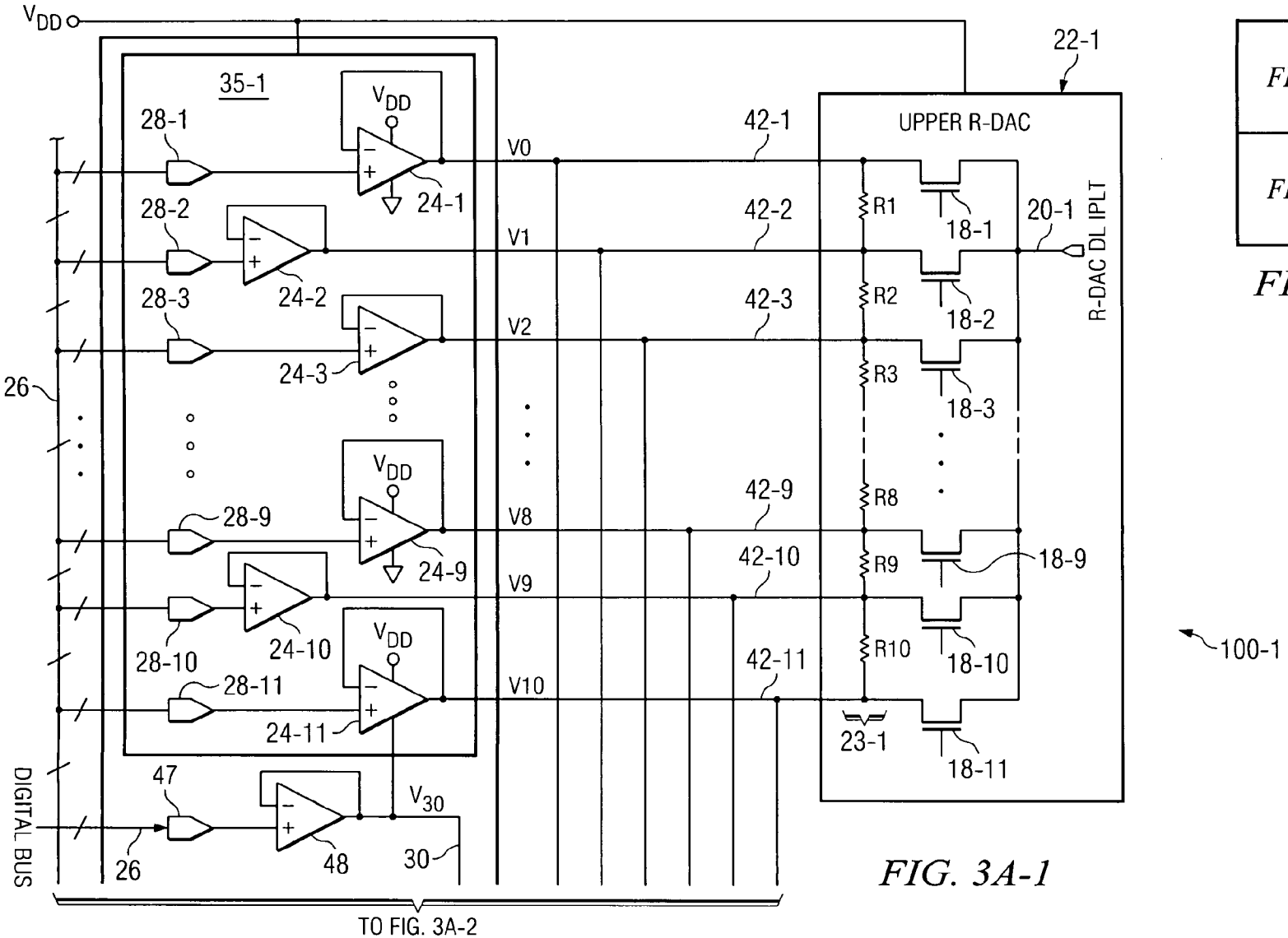
Figures 2, 3A:
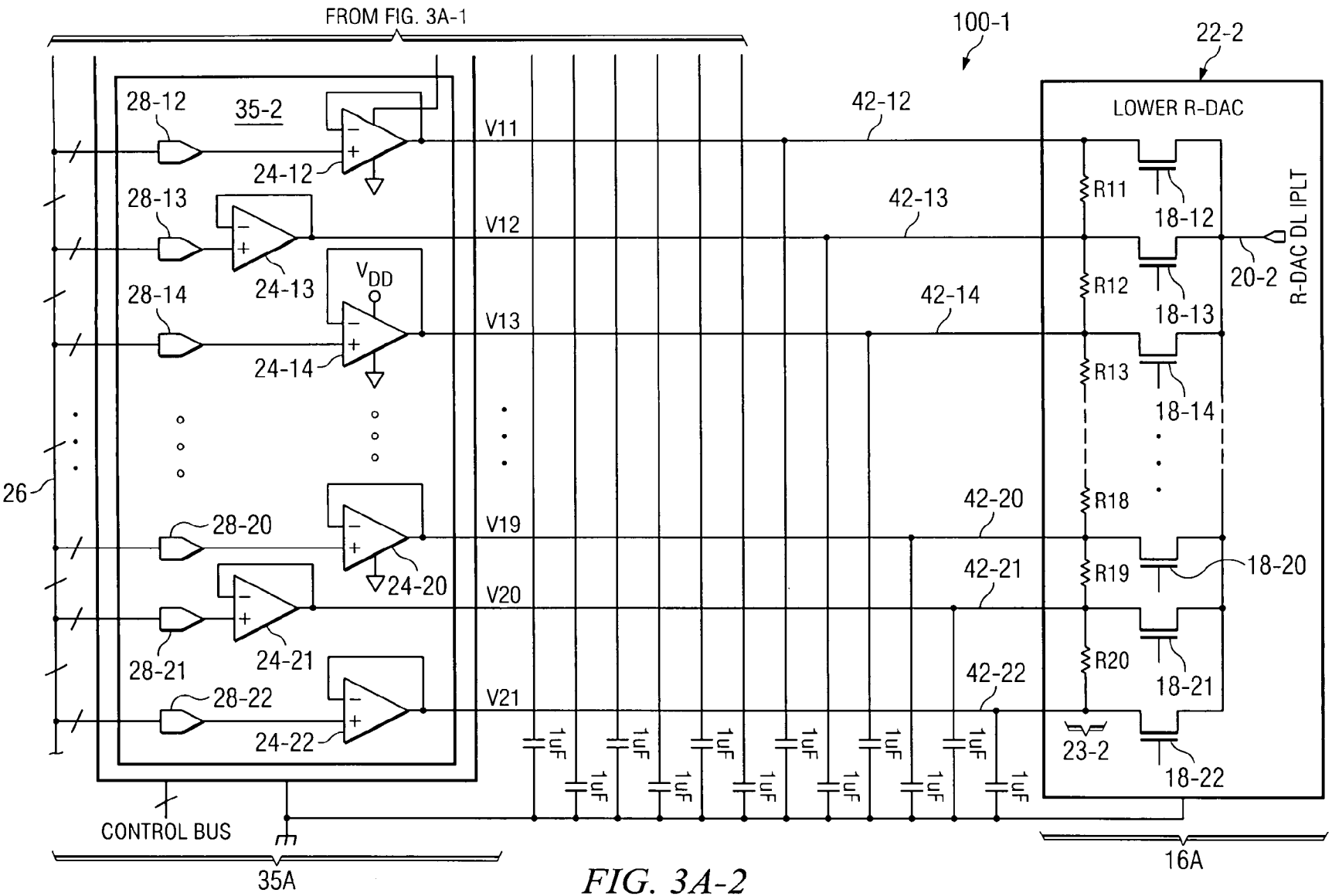

FIG. 3A shows circuitry 100-1 which includes an improvement according to the present invention provided in combination with gamma reference voltage generator circuitry generally as shown in block 35 of Prior Art FIG. 1. Circuitry 100-1 also includes source driver circuitry generally as shown in block 16 of Prior Art FIG. 1.

The improved gamma reference voltage generator circuitry 35A in FIG. 3A provides reduced power dissipation, and also provides reduced physical size of output transistors in some of the gamma correction buffer amplifiers. The improved gamma reference voltage circuitry 35A in FIG. 3A includes 11 "upper" DAC/buffer circuits in block 35-1 and 11 "lower" DAC/buffer circuits in block 35-2. Each DAC/buffer circuit includes a DAC, the output of which is connected to an input of a buffer amplifier. Specifically, block 35-1 includes DACs 28-1,2 . . . 11 having outputs coupled to the (+) input of upper buffer amplifiers 24-1,2 . . . 11, respectively. The output of each of upper buffer amplifiers 24-1,2 . . . 11 is connected by a corresponding one of conductors 42-1,2 . . . 11 to the (−) input of that one of buffer amplifiers 24-1,2 . . . 11. Similarly, block 35-2 includes lower DACs 28-12,13 . . . 22 each having an output coupled to the (+) input of a lower buffer amplifier 24-12,13 . . . 22, respectively. The outputs of lower buffer amplifiers 24-12,13 . . . 22 are connected by conductors 42-12,13 . . . 22 to the (−) inputs of lower buffer amplifiers 24-12,13 . . . 22, respectively. (Buffer amplifiers 24-1,2 . . . 22 and DACs 28-1,2 . . . 22 are sometimes collectively referred to herein as "buffers 24" and "DACs 28", respectively.) The digital inputs of DACs 28-1,2 . . . 22 are connected to an external digital bus 26 by means of which desired values of the voltages V0,1,2 . . . 21 can be programmed into DACs 28-1,2 . . . 22.

Source driver circuitry 16A in FIG. 3A corresponds to source driver circuitry 16 in Prior Art FIG. 1, and includes an upper R-DAC 22-1 having inputs coupled to conductors 42-1,2 . . . 11, respectively, and a lower R-DAC 22-2 having inputs coupled to conductors 42-12,13 . . . 22, respectively. Upper R-DAC 22-1 includes a resistor string 23-1 including resistor R1 connected between conductors 42-1 and conductors 42-2, resistor R2 connected between conductors 42-2 and 42-3, etc., with resistor R10 being connected between conductors 42-10 and 42-11. Similarly, lower R-DAC 22-2 includes a resistor string 23-2 including resistor R11 connected between conductors 42-12 and conductors 42-13, resistor R12 connected between conductors 42-13 and 42-14, etc., with resistor R20 being connected between conductors 42-21 and 42-22.

Upper gamma reference voltage generator circuitry 35-1 and lower gamma reference voltage generator circuitry 35-2 in FIG. 3A are somewhat similar to what is shown in block 35 of Prior Art FIG. 1. Upper R-DAC 22-1 in FIG. 3A includes switches 18-1,2 . . . 11 (which are comparable to switches in block 18 of Prior Art FIG. 1) coupled between R-DAC output conductor 20-1 and buffer output conductors 42-1,2 . . . 11, respectively. Similarly, lower R-DAC 22-2 includes switches 18-11,12 . . . 22 coupled between R-DAC output conductor 20-2 and buffer output conductors 42-12,13 . . . 22, respectively. The gates of switches 18-1,2 . . . 22 are controlled in response to the image data, e.g., from controller circuitry 32 on bus 36 in Prior Art FIG. 1. R-DAC output conductors 20-1 and 20-2 are connected to appropriate column input terminals, which can be the brightness control terminals of an LCD display panel 11, as shown in Prior Art FIG. 1. In a state-of-the-art LCD display, there may be many more than 2 brightness control input terminals, and consequently there may be many more than 2 R-DACs.

In FIG. 3A, the output of a "midrange" DAC 47 is connected to the (+) input of a "midrange" buffer amplifier 48, the output 30 of which produces a midrange supply voltage $V_{30}$ as a programmable supply voltage (although some other voltage source could be used to provide $V_{30}$, for example as indicated in subsequently described FIG. 6A or FIG. 6B). In accordance with the embodiment of the invention shown in FIG. 3A, a preferably programmable midrange supply voltage $V_{30}$ is applied to the low-side supply voltage terminal of midrange gamma correction buffer 24-11 and to the high-side supply voltage terminal of midrange gamma correction buffer 24-12. The other gamma correction buffers can be connected between $V_{DD}$ and ground, or preferably $V_{30}$ could also be connected to the low-side supply voltage terminals of the receiving gamma correction buffers in block 35-1, and to the high-side supply voltage terminals of the remaining gamma correction buffers in block 35-2.

For a particular LCD display 11, there usually is just one gamma reference voltage generator circuit 35A including upper DAC/buffer circuit 35-1 and lower DAC/buffer circuit 35-2. However, a single LCD display may require a number (e.g., 8 to 12 or more) of identical R-DAC circuits 16A each including an upper R-DAC 22-1 and a lower R-DAC 22-2. The corresponding resistor values would be the same in each of the multiple R-DAC circuits 16A, and the connections to conductors 42-1,2, . . . 22 (the voltages of which would be set by the various gamma correction buffers 24-1,2 . . . ) would be the same for each of the multiple R-DAC circuits 16A.

Figure 3B:
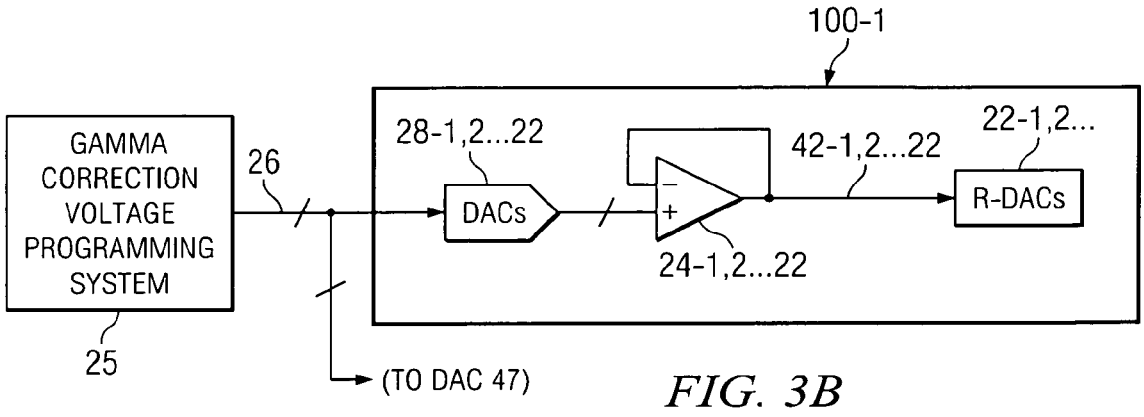
FIG. 3B is a block diagram including a gamma correction voltage programming system coupled to the gamma correction circuitry of FIG. 3A.

FIG. 3B shows a connection of circuitry 100-1 of FIG. 3A coupled to a gamma correction voltage programming system 25 which programs voltages corresponding to the needed gamma correction currents into DACs 28-1,2 . . . 22 via digital bus 26. Gamma correction voltage programming system 25 also programs digital voltages which are input to midrange DAC 47 in order to generate the midrange voltage $V_{30}$. Gamma correction voltage programming system 25 could be included within block 100-1 if desired.

FIG. 3B shows that gamma correction voltage programming system 25 programs all of DACs 28-1,2 . . . 22 by means of digital bus 26 to cause gamma correction buffers 24-1, 2 . . . 22 to generate gamma correction currents into resistor strings 23-1 and 23-2 which would be suitable for a particular LCD display 11 to which gamma correction circuitry 100-1 is to be connected. Gamma correction voltage programming system 25 also programs DAC 47 and midrange supply voltage generating buffer 48 to produce a value of $V_{30}$ that is between the output voltage V10 of gamma correction buffer 24-11 and the output voltage V11 of gamma correction buffer 24-12 for an LCD display (e.g., panel 11 in FIG. 1). Preferably, the value of $V_{30}$ is programmed to have a value that is optimally midway between the output voltage V10 of gamma correction buffer 24-11 and the output voltage VII of gamma correction buffer 24-12.

Figure 4:
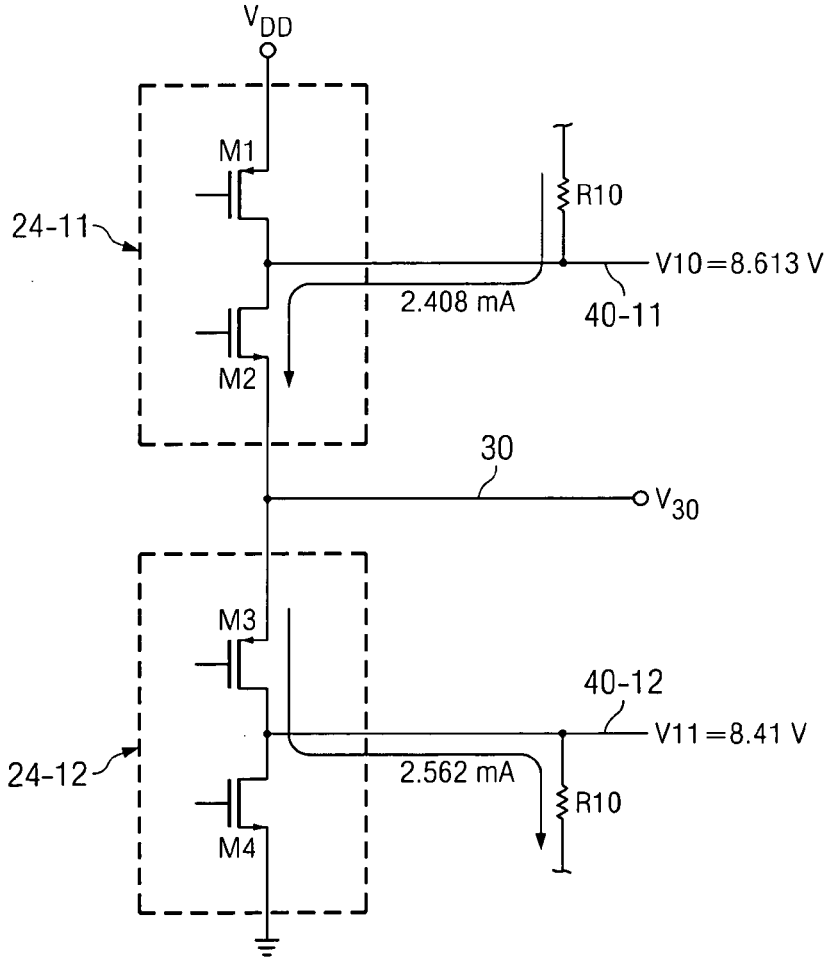
FIG. 4 is a schematic diagram showing the output transistors and currents therein for gamma correction buffers 24-11 and 24-12 in FIG. 3A.

FIG. 4 shows the output transistors in midrange gamma correction buffers 24-11 and 24-12. Buffer 24-11 includes a P-channel output transistor M1 having its source connected to $V_{DD}$ and its drain connected by conductor 40-11 to the drain of a N-channel transistor M2, the source of which is connected to midrange supply voltage conductor 30. Buffer 24-12 includes P-channel output transistor M3 having its source connected to midrange supply voltage conductor 30 and its drain connected by conductor 40-12 to the drain of N-channel output transistor M4, which has its source connected to ground.

Figures 1, 2:
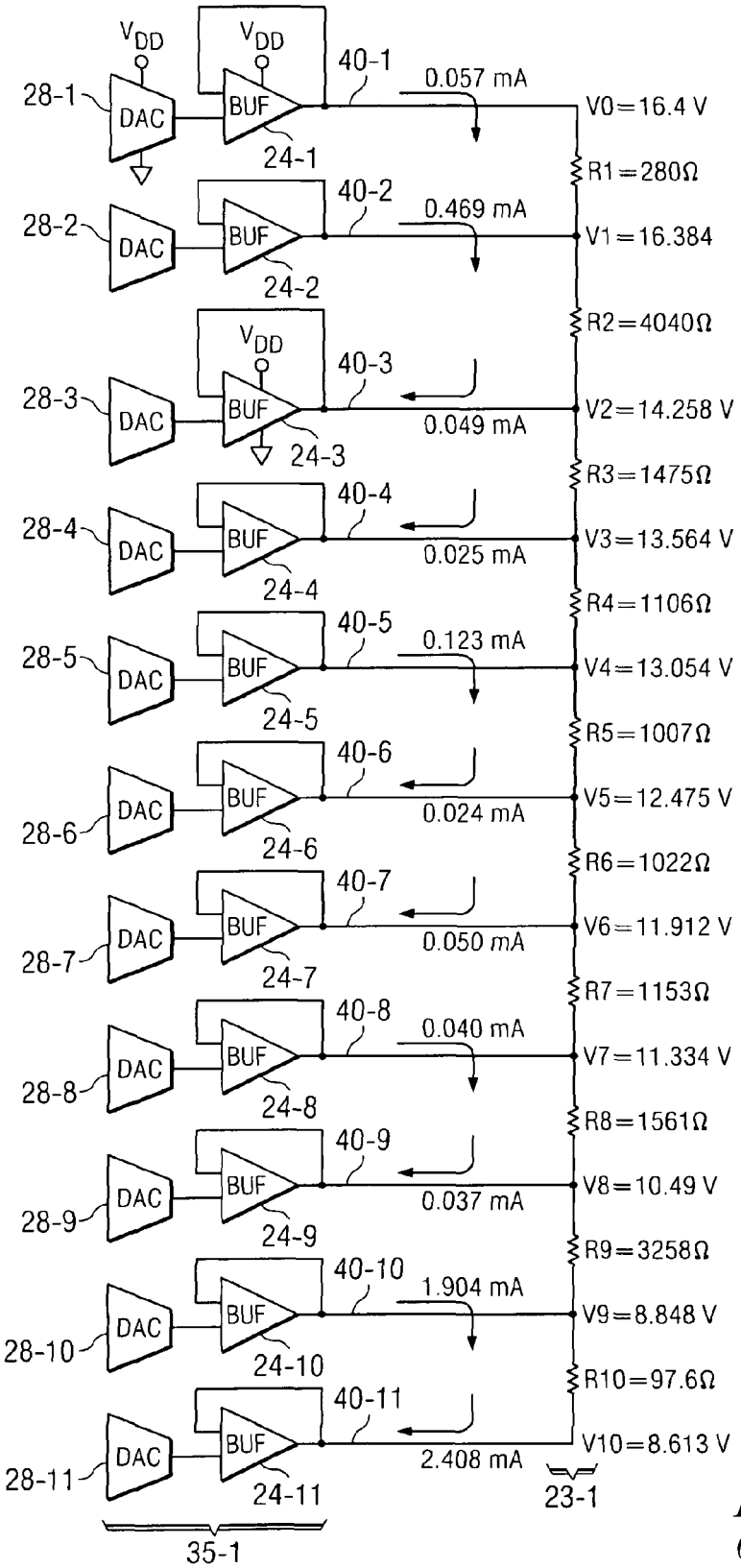
FIG. 2-1 (PRIOR ART)
Figure 2:
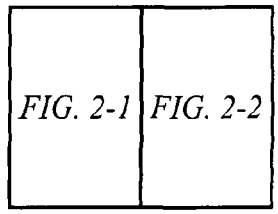
FIG. 2 (PRIOR ART)
Figure 2:
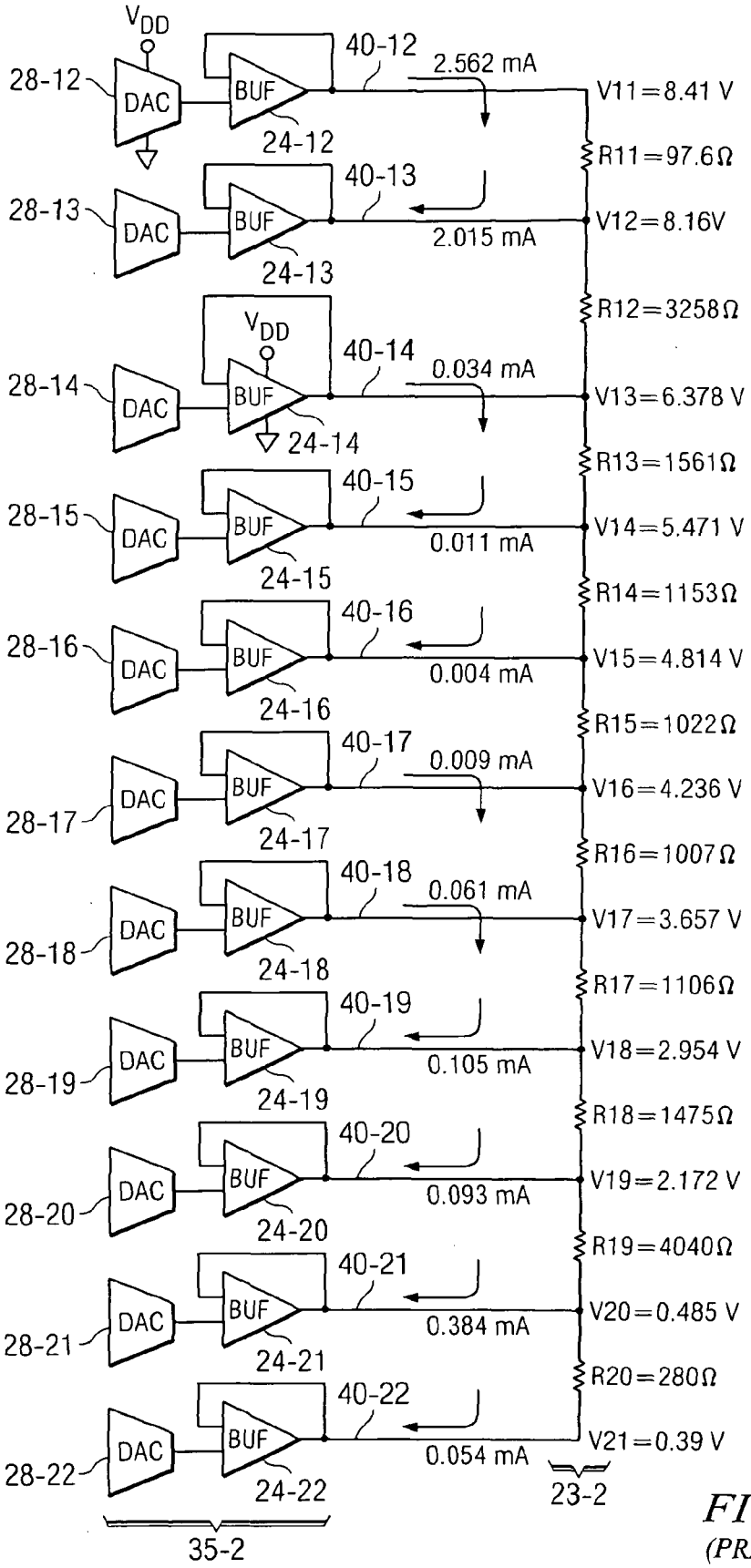
FIG. 2-2 (PRIOR ART)

For the resistor values R1,2 . . . 20 and programmed voltage values V0,1 . . . 21 indicated in previously described FIG. 2, with $V_{DD}$ equal to 18 volts, the drain-source voltage drop across output transistor M2 of gamma correction buffer 24-11 is V10−$V_{30}$ volts, wherein V10=8.613 volts and the current flowing through that voltage drop is 2.408 mA. The power dissipated in output transistor M2 therefore is 2.408×(8.163−$V_{30}$) milliwatts, which is far lower than the 2.408×8.613=20.74 milliwatts that would be consumed in the example of Prior Art FIG. 2. Similarly, the drain-source voltage drop across output transistor M3 of gamma correction buffer 24-12 is V11 (i.e., 8.41 volts) volts and the current flowing through that voltage drop is 2.562 mA. The power dissipated in output transistor M3 therefore is 2.2562×($V_{30}$−8.41) milliwatts, which is much lower than the (22.562)×($V_{DD}$−8.41) milliwatts in the example of Prior Art FIG. 2.

Thus, the invention provides a way of providing midrange supply voltages to the midrange gamma correction buffers which otherwise would dissipate the largest amounts of power and thereby substantially reduces the amount of power dissipated therein.

A possible problem of the embodiment of the invention shown in FIG. 3A is that the programmed values of V10 and V11 may be so close together that the voltage drops across transistors M2 and M3 of gamma correction buffers 24-11 and 24-12 in FIG. 4 may be extremely small. This would necessitate making the channel-width-to-channel-length ratios of those two transistors very large, resulting in undesirably large transistor sizes in order to provide sufficiently low channel resistance in transistors M2 and M3 to enable them to "pull" voltages V10 and V11 close enough to midrange supply voltage $V_{30}$ to attain their correct programmed values.

Figure 5:
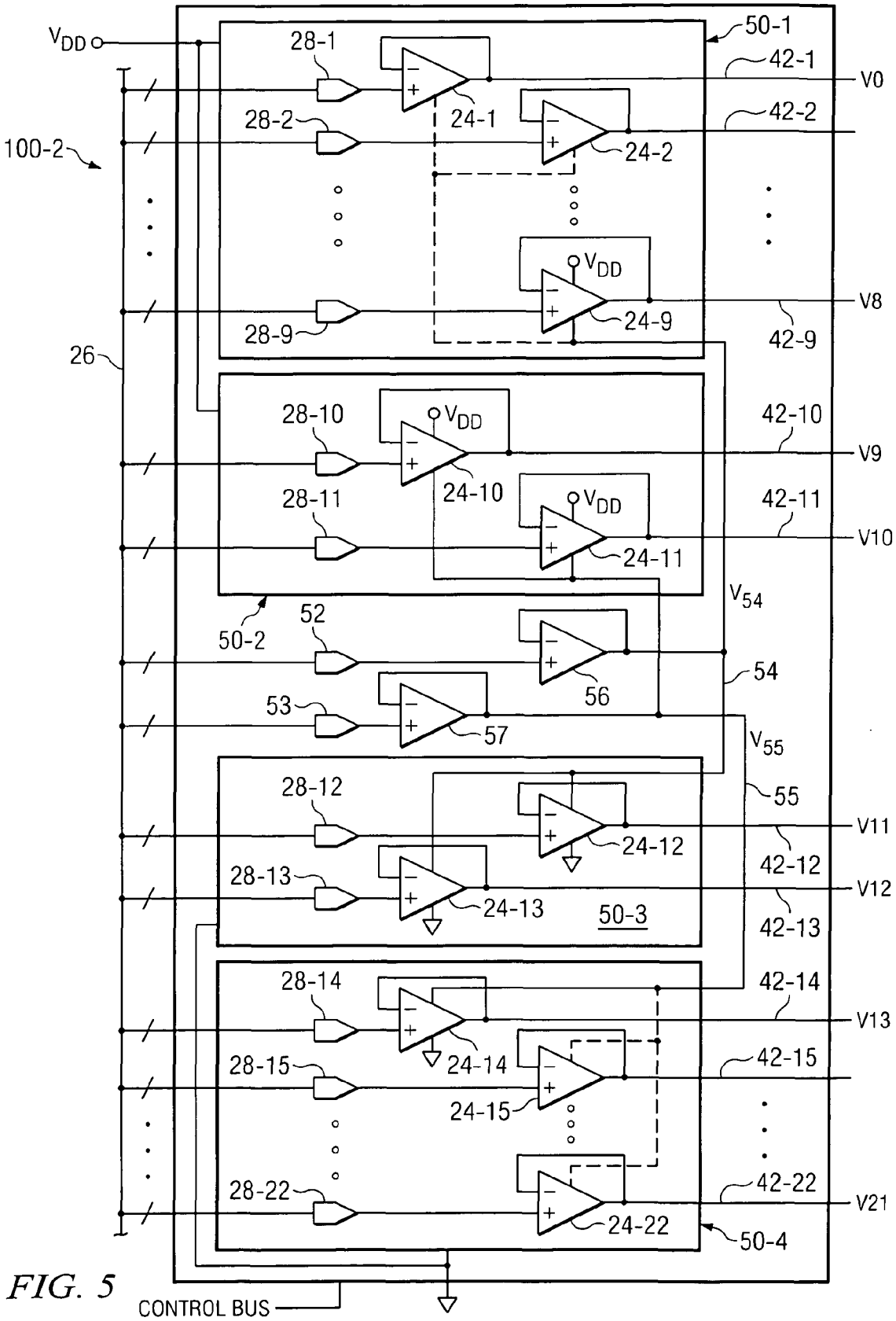
FIG. 5 is a schematic diagram of another embodiment of gamma correction circuitry of the present invention.

FIG. 5 shows a schematic diagram of a presently preferred embodiment of the invention which avoids the foregoing problem by providing one or more additional midrange supply voltage circuits. In FIG. 5, DAC 52 and gamma correction buffer 56 provide a first programmed midrange supply voltage $V_{54}$ on conductor 54, which is connected to the low-side supply voltage terminal of at least gamma correction buffer 24-9, the high-side supply voltage terminal of which is connected to $V_{DD}$. $V_{54}$ is also connected to the high-side supply voltage terminals of gamma correction buffers 24-12 and 24-13, the low-side supply voltage terminals of which are connected to ground. As indicated in the dashed line extension of conductor 54, the midrange voltage $V_{54}$ preferably also is connected to the low-side supply voltage terminals of more or even all of the other gamma correction buffers 24-1, 2 . . . in block 50-1 to reduce their power consumption.

Similarly, DAC 53 and gamma correction buffer 57 provide a second programmed midrange Supply voltage $V_{55}$ on conductor 55, which is connected to the high-side supply voltage terminal of at least gamma correction buffer 24-14, the low-side supply voltage terminal of which is connected to ground. $V_{55}$ is also connected to the low-side supply voltage terminals of gamma correction buffers 24-11 and 24-10, the high-side supply voltage terminals of which are connected to $V_{DD}$. As indicated in the dashed line extension of conductor 55, the midrange voltage $V_{55}$ preferably also is connected to the high-side supply voltage terminals of more or even all of the other gamma correction buffers 24-15, 16 . . . in block 50-4 to reduce their power consumption.

Use of midrange voltage $V_{54}$ as the low-side supply voltage terminal for one or more gamma correction buffers in block 50-1 ensures that the voltage difference between conductors 42-12 and 42-9 is large enough that it is not necessary to provide excessively large output transistors in midrange buffer 56 or in gamma correction buffer 24-9. Similarly, use of midrange voltage $V_{55}$ as the low-side supply voltage terminal for gamma correction buffers in block 50-4 ensures that the voltage difference between conductor 42-13 and conductor 42-14 is large enough that it is not necessary to provide excessively large output transistors in midrange buffer 57 or in gamma correction buffer 24-13.

The embodiment of FIG. 5 allows the gamma correction voltage programming system 25 in FIG. 3B to choose and program an appropriate intermediate supply voltage buffer such that none of the programmed output voltages result in sufficiently low voltages across any gamma correction buffer that excessively large output transistors are required therein. Thus, the topology of FIG. 5 provides an additional intermediate or midrange power conductor and supply voltage approximately midway between the normal supplies $V_{DD}$ and ground. Since the middle gamma correction buffers then are sufficiently close to a midrange supply voltage, i.e., either $V_{54}$ or $V_{55}$, connected to both of buffers 24-12 and 24-13, the size of the gamma correction buffer output transistors can be smaller, and the power dissipated in gamma correction buffers is very small, i.e. roughly half that of the power dissipated in gamma correction buffers according to the prior art.

Figure 6A:
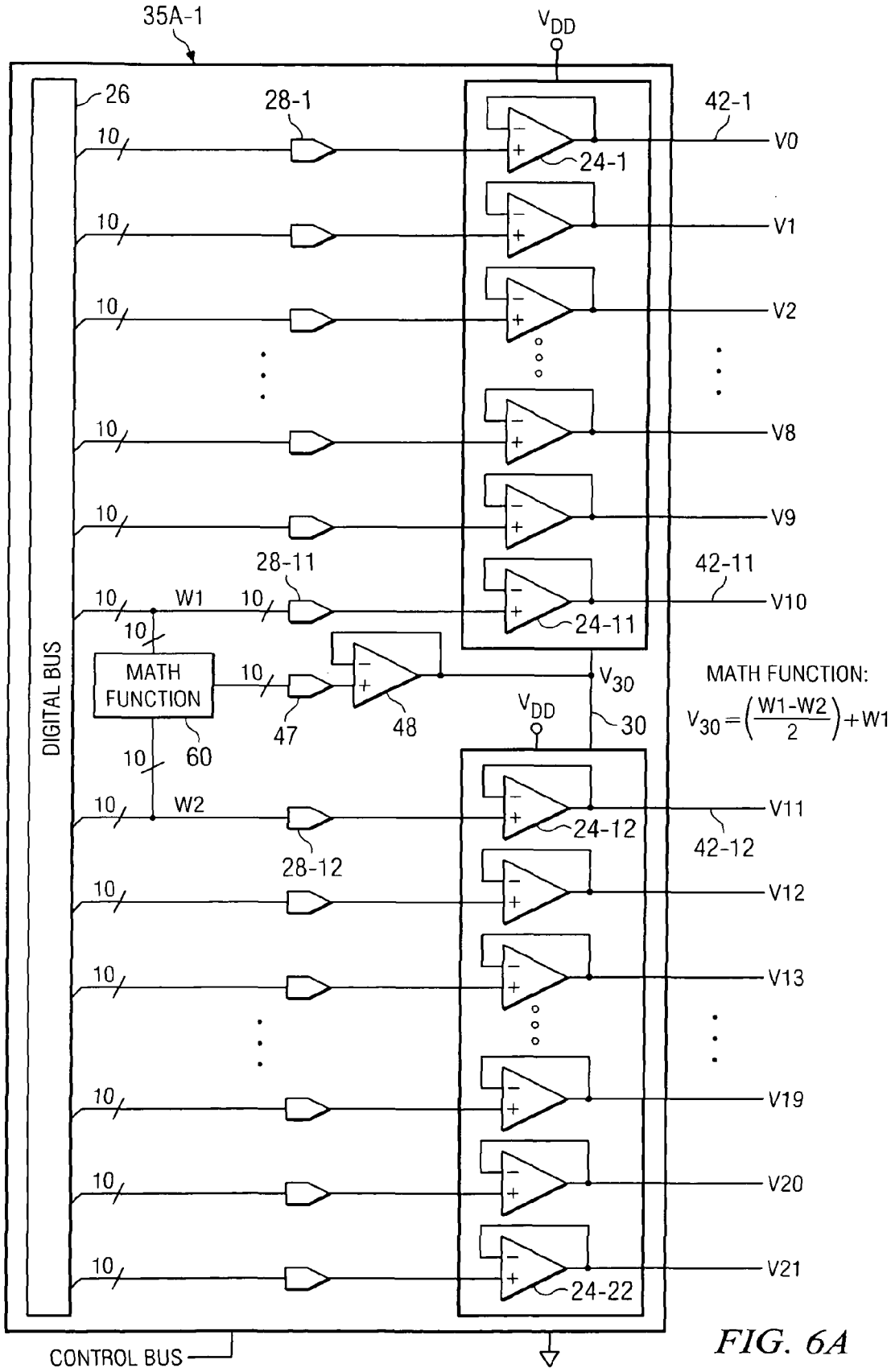
FIG. 6A is a schematic diagram of another embodiment of gamma correction circuitry of the present invention.

FIG. 6A shows a gamma reference voltage generator circuit 35A-1 which is a variation of the gamma reference voltage generator circuit 35A shown in FIG. 3A. In FIG. 6A, the circuitry is essentially the same as in FIG. 3A except that the input of DAC 47 is not coupled directly to digital bus 26.

Instead, in FIG. 6A the digital word WI programmed via digital bus 26 into DAC 28-11 is also entered into a digital math function circuit 60, and the digital word W2 programmed via digital bus 26 into DAC 28-12 is also entered into math function circuit 60. The digital output of math function circuit 60 is provided as an input to DAC 47. Digital math function circuit 60 performs the function of computing $V_{30}$ according to the relationship $$V_{30}=\{(W1-W2)/2\}+W1.$$

That value is provided as an input to the (+) input of unity gain buffer 48, which produces the voltage $V_{30}$ on conductor 30. For the foregoing mathematical expression, $V_{30}$ will be halfway between V10 and V11. However, other math functions could be utilized to provide a different value of $V_{30}$. Alternatively, the function of math function circuit 60 could be performed by an analog circuit which receives the analog outputs of DACs 28-11 and 28-12 as inputs and generates an analog output connected to the (+) input of unity gain buffer 48 the use of math function circuit 60 is equally applicable to the embodiment of FIG. 5.

Figure 6B:
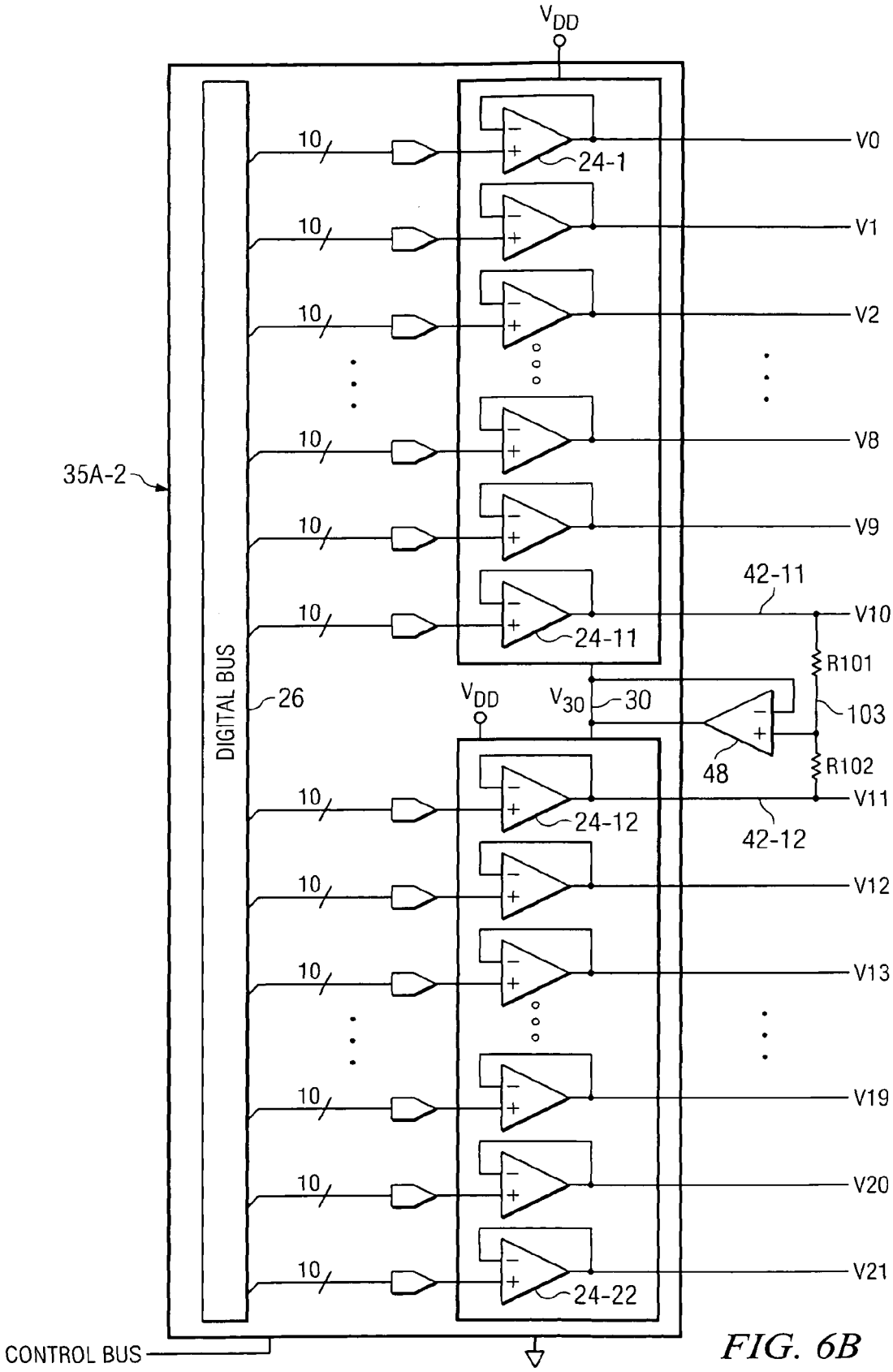
FIG. 6B is a schematic diagram of yet another embodiment of gamma correction circuitry of the present invention.

FIG. 6B shows a gamma reference voltage generator circuit 35A-2 which is another variation of the gamma reference voltage generator circuit 35A shown in FIG. 3A. In FIG. 6B, the circuitry is essentially the same as in FIG. 3A except DAC 47 is omitted and the (+) input of gamma correction buffer 48 is connected to the junction 103 between resistors R101 and R102 which are connected in series between conductors 42-11 and 42-12. If the resistances R101 and R102 are equal, then $V_{30}$ is halfway between V10 and V11. Again, the technique of FIG. 6B is equally applicable to the embodiment of FIG. 5. Note that resistors R101 and R102 must be sufficiently small as not to significantly increase the current that must be supplied by gamma correction buffer 24-11 and sunk by gamma correction buffer 24-12. The actual value preferably is not exactly halfway between them, and instead should be chosen somewhere near halfway between them, but at a voltage that minimizes the size of the output transistors in 24-11 and 24-12.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. For example, the gamma correction buffers/amplifiers (referred to herein as gamma correction buffers) such as 24-1,2 . . . can be replaced by an operational amplifier having a (+) input coupled to the output of a corresponding DAC 28-1,2 . . . and a (−) input coupled to the junction between a feedback resistor and a gain resistor coupled to ground which together determine the gain of the operational amplifier. This would allow a reduction in supply voltage applied to the high-side supply voltage terminal of each DAC, depending on the gain of the operational amplifier. This alternative also may permit use of an inexpensive, low-voltage DAC.

By way of definition, it is to be understood that the term "buffer" as used herein is not intended to be limited to any particular kind of buffer circuit. The term "buffer" as used herein is intended to encompass any kind of amplifier circuit that is utilized to generate the various voltages on conductors 42-1,2 . . . and the various midrange supply voltages such as $V_{54}$ and $V_{55}$.

What is claimed is:

1. An apparatus comprising:

a first reference voltage generator having a first group of gamma correction buffer circuits and digital-to-analog converters (DACs), each gamma correction buffer circuit of the first group having an input coupled to an output of a corresponding DAC of the first group, respectively, and an output coupled by a corresponding output conductor, respectively, to a corresponding tap point of a first resistor string;

a second reference voltage generator having a second group of gamma correction buffer circuits and DACs, each gamma correction buffer circuit of the second group having an input coupled to an output of a corresponding DAC of the second group, respectively, and an output coupled by a corresponding output conductor, respectively, to a corresponding tap point of a second resistor string, the gamma curve correction circuitry being coupled to receive a first supply voltage and a second supply voltage;

a midrange supply voltage circuit having an input that is coupled to the first and second reference voltage generators, wherein the midrange supply voltage circuit is configured to produce a midrange supply voltage having a value approximately midway between the first supply voltage and the second supply voltage; and a first gamma correction buffer of the first group having a high-side supply voltage terminal coupled to receive the first supply voltage and a low-side supply voltage terminal coupled to receive the midrange supply voltage, and a second gamma correction buffer of the second group having a low-side supply voltage terminal coupled to receive the second supply voltage and a high-side supply voltage terminal coupled to receive the midrange supply voltage to reduce power consumption of the first gamma correction buffer of the first group and the first gamma correction buffer of the second group.

2. The apparatus of claim 1, wherein the DACs of the first and second groups are programmable via a digital bus to cause corresponding gamma correction buffers of the first and second groups to generate predetermined gamma curve correction currents in the corresponding output conductors of the first and second groups.

3. The apparatus of claim 2, wherein the predetermined gamma curve correction currents in the corresponding output conductors of the first and second groups cause corresponding programmed voltages representative of a corrected gamma curve of an image display device to be produced on the corresponding output conductors of the first and second groups, respectively.

4. The apparatus of claim 2, wherein the midrange supply voltage circuit is programmable to generate the midrange supply voltage approximately midway between the first supply voltage and the second supply voltage.

5. The apparatus of claim 4, wherein the midrange supply voltage circuit includes a first DAC having an output coupled to an input of a first buffer, the first buffer having an output coupled to conduct the midrange supply voltage.

6. The apparatus of claim 3, wherein the image display device is an LCD panel.

7. The apparatus of claim 1, wherein a non-inverting input of each gamma correction buffer circuit is coupled to the output of the corresponding DAC, respectively, and wherein the output of each gamma correction buffer circuit is coupled to an inverting input of that gamma correction buffer circuit.

8. The apparatus of claim 1, wherein most of the gamma correction buffer circuits of the first group and most of the gamma correction circuits of the second group have high-side supply voltage terminals coupled to the first supply voltage and low-side supply voltage terminals coupled to the second supply voltage.

9. The apparatus of claim 3, wherein midrange supply voltage circuit and the midrange supply voltage further comprises a first midrange supply voltage circuit and a first midrange supply voltage, respectively, and wherein the apparatus further comprises a second midrange supply voltage circuit that is configured to produce a second midrange supply voltage having a value different than the first midrange supply voltage but also approximately midway between the first supply voltage and the second supply voltage.

10. The apparatus of claim 5, wherein the first DAC is programmable via the digital bus.

11. The apparatus of claim 10, wherein an input of the first DAC is coupled to the digital bus by means of a math function circuit which computes a digital value of the midrange supply voltage between a first midrange programmed voltage produced by a first midrange one of the gamma correction buffer circuits and a second midrange programmed voltage produced by a second midrange one of the gamma correction buffer circuits.

12. An apparatus comprising:

a bus;

a first supply rail that is configured to have a first supply voltage;

a second supply rail that is configured to have a second supply voltage;

a first gamma reference voltage generator having:

a first set of digital-to-analog converters (DACs), wherein each DAC from the first set of DACs is coupled to the bus; and a first set of buffers, wherein each buffer from the first set of buffers is coupled to at least one of the DACs from the first set of DACs, and wherein each buffer from the first set of buffers has a first supply terminal and a second supply terminal, and wherein the first supply terminal of each buffer from the first set of buffers is coupled to the first supply rail;

a second gamma reference voltage generator having:

a second set of DACs, wherein each DAC from the second set of DACs is coupled to the bus; and a second set of buffers, wherein each buffer from the second set of buffers is coupled to at least one of the DACs from the second set of DACs, and wherein each buffer from the second set of buffers has a first supply terminal and a second supply terminal, and wherein the second supply terminal of each buffer from the second set of buffers is coupled to the second supply rail;

a midrange supply circuit having an input that is coupled to first and second gamma reference voltage generators and an output that is coupled to the second terminal of at least one of the buffers from the first set of buffers and that is coupled to the first terminal of at least one of the buffers from the second set of buffers, wherein the midrange supply circuit is configured to provide a midrange voltage that is approximately midway between the first supply voltage and the second supply voltage;

a first resistor DAC (R-DAC) that is coupled to each buffer from the first set of buffers; and a second R-DAC that is coupled to each buffer from the second set of buffers.

13. The apparatus of claim 12, wherein the midrange supply circuit further comprises:

a midrange DAC that is coupled to the bus; and a midrange buffer that is coupled to the midrange DAC.

14. The apparatus of claim 13, wherein the midrange buffer is coupled to the second terminal of each buffer from the first set of buffers and the first terminal of each buffer from the second set of buffers.

15. The apparatus of claim 13, wherein the midrange DAC and the midrange buffer further comprise a first midrange DAC and a first midrange buffer, respectively, and wherein first midrange buffer is coupled to the second terminal of at least one of the buffers from the first set of buffers and the first terminal of at least one of the buffers from the second set of buffers, and wherein the midrange supply circuit further comprises:

a second midrange DAC that is coupled to the bus; and a second midrange buffer that is coupled to the second midrange DAC, wherein second midrange buffer is coupled to the second terminal of at least one of the buffers from the first set of buffers and the first terminal of at least one of the buffers from the second set of buffers.

16. The apparatus of claim 13, wherein the midrange supply circuit further comprises a math function circuit that is coupled to an input of at least one of the DACs from the first set of DACs and an input of at least one of the DACs from the second set of DACs.

17. The apparatus of claim 12, wherein the midrange supply circuit further comprises:

a voltage divider that is coupled to an output of at least one of the buffers from the first set of buffers and an output of at least one of the buffers from the second set of buffers; and a midrange buffer that is coupled to the voltage divider.

18. The apparatus of claim 17, wherein the midrange buffer is coupled to the second terminal of each buffer from the first set of buffers and the first terminal of each buffer from the second set of buffers.

* * * * *